US008794204B2

(12) United States Patent
Hayman et al.

(10) Patent No.: US 8,794,204 B2
(45) Date of Patent: Aug. 5, 2014

(54) VALVETRAIN FOR OVERHEAD VALVE ENGINE

(75) Inventors: Alan W. Hayman, Romeo, MI (US); Eric C. Douse, Bloomfield Hills, MI (US); Robert S. McAlpine, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1415 days.

(21) Appl. No.: 12/505,594

(22) Filed: Jul. 20, 2009

(65) Prior Publication Data

US 2010/0269773 A1 Oct. 28, 2010

Related U.S. Application Data

(60) Provisional application No. 61/171,750, filed on Apr. 22, 2009.

(51) Int. Cl.
*F01L 1/18* (2006.01)

(52) U.S. Cl.
USPC ..... 123/90.44; 123/90.16

(58) Field of Classification Search
USPC ..... 123/90.16, 90.39, 90.44, 90.61–90.64, 123/90.61–90.64, 90.15
See application file for complete search history.

(56) References Cited

U.S. PATENT DOCUMENTS

| | | | | |
|---|---|---|---|---|
| 2,678,641 | A * | 5/1954 | Ryder | 123/90.16 |
| 7,404,386 | B1 * | 7/2008 | Raghavan et al. | 123/90.39 |
| 7,434,556 | B2 * | 10/2008 | Harmon | 123/90.44 |
| 8,033,261 | B1 * | 10/2011 | Robbins | 123/90.44 |
| 2006/0086330 | A1 * | 4/2006 | Harmon | 123/90.16 |
| 2008/0190386 | A1 * | 8/2008 | Raghavan et al. | 123/90.1 |
| 2009/0038572 | A1 * | 2/2009 | Langewisch et al. | 123/90.44 |

OTHER PUBLICATIONS

Drawing—Ilmor E/P Pushrod Indy V8 (1 page).

* cited by examiner

*Primary Examiner* — Thomas Denion
*Assistant Examiner* — Daniel Bernstein
(74) *Attorney, Agent, or Firm* — Harness, Dickey & Pierce, P.L.C.

(57) ABSTRACT

An engine assembly may include an engine structure, a camshaft rotationally supported within the engine structure and including a lobe, a first rocker arm, a valve lift mechanism, a valve, and a second rocker arm. The first rocker arm may include a first end rotationally coupled relative to the engine structure and a second end defining a cam engagement surface engaged with the lobe and a convex lift surface opposite the cam engagement surface. The valve lift mechanism may have a first end engaged with the lift surface of the first rocker arm. The second rocker arm may be supported relative to the engine structure and engaged with a second end of the valve lift mechanism and the valve to selectively open the valve based on displacement of the lift mechanism by the first rocker arm.

13 Claims, 5 Drawing Sheets

VALVETRAIN FOR OVERHEAD VALVE ENGINE

CROSS-REFERENCE TO RELATED APPLICATIONS

This application claims the benefit of U.S. Provisional Application No. 61/171,750, filed on Apr. 22, 2009. The entire disclosure of the above application is incorporated herein by reference.

FIELD

The present disclosure relates to overhead valve engines and, more particularly, to valvetrains for overhead valve engines.

BACKGROUND

This section provides background information related to the present disclosure which is not necessarily prior art.

Internal combustion engines may combust a mixture of air and fuel in cylinders and thereby produce drive torque. Air and fuel flow into and out of the cylinders may be controlled by a valvetrain. Valvetrains typically include a camshaft that actuates intake and exhaust valves and thereby controls the timing and amount of air and fuel entering the cylinders and exhaust gases leaving the cylinders. Overhead valve (OHV) valvetrains typically include lifters, pushrods, and rocker arms coupled to the intake and exhaust valves. In OHV designs, the camshaft may be located adjacent the cylinders while the intake and exhaust valves may be located above the cylinders. The camshaft actuates the intake and exhaust valves via the lifters, push rods, and rocker arms.

SUMMARY

A valve actuation assembly may include a first rocker arm, a valve lift mechanism and a second rocker arm. The first rocker arm may include a first end defining a pivot region to rotationally couple the first rocker arm to an engine structure and a second end defining a cam engagement surface adapted to engage a camshaft lobe and a convex lift surface opposite the cam engagement surface. The valve lift mechanism may have a first end engaged with the lift surface of the first rocker arm. The second rocker arm may be engaged with a second end of the valve lift mechanism to selectively open a valve based on displacement of the lift mechanism by the first rocker arm.

An engine assembly may include an engine structure, a camshaft rotationally supported within the engine structure and including a lobe, a first rocker arm, a valve lift mechanism, a valve, and a second rocker arm. The first rocker arm may include a first end rotationally coupled relative to the engine structure and a second end defining a cam engagement surface engaged with the lobe and a convex lift surface opposite the cam engagement surface. The valve lift mechanism may have a first end engaged with the lift surface of the first rocker arm. The second rocker arm may be supported relative to the engine structure and engaged with a second end of the valve lift mechanism and the valve to selectively open the valve based on displacement of the lift mechanism by the first rocker arm.

An engine assembly may include an engine structure, a camshaft, first and second shafts, and first, second, and third rocker arms. The engine structure may define first and second banks of cylinders disposed at an angle relative to one another. The camshaft may be rotationally supported within the engine structure between the first and second banks and may include lobes. The first shaft may be fixed to the engine structure between the first and second banks on a first side of the camshaft adjacent the second bank. The second shaft may be fixed to the engine structure between the first and second banks on a second side of the camshaft adjacent the first bank.

The first rocker arm may extend from the first shaft toward the first bank and may include a first end rotationally coupled the first shaft and a second end defining a first cam engagement surface engaged with a first of the camshaft lobes and a first convex lift surface opposite the first cam engagement surface engaged with a first valve lift mechanism associated with the first bank. The second rocker arm may extend from the first shaft toward the first bank and may include a first end rotationally coupled to the first shaft and a second end defining a second cam engagement surface engaged with a second of the camshaft lobes and a second convex lift surface opposite the second cam engagement surface engaged with a second valve lift mechanism associated with the first bank.

The third rocker arm may extend from the second shaft toward the second bank between the first and second rocker arms. The third rocker arm may include a first end rotationally coupled to the second shaft and a second end defining a third cam engagement surface engaged with a third of the camshaft lobes and a third convex lift surface opposite the third intake cam engagement surface engaged with a third valve lift mechanism associated with the second bank.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
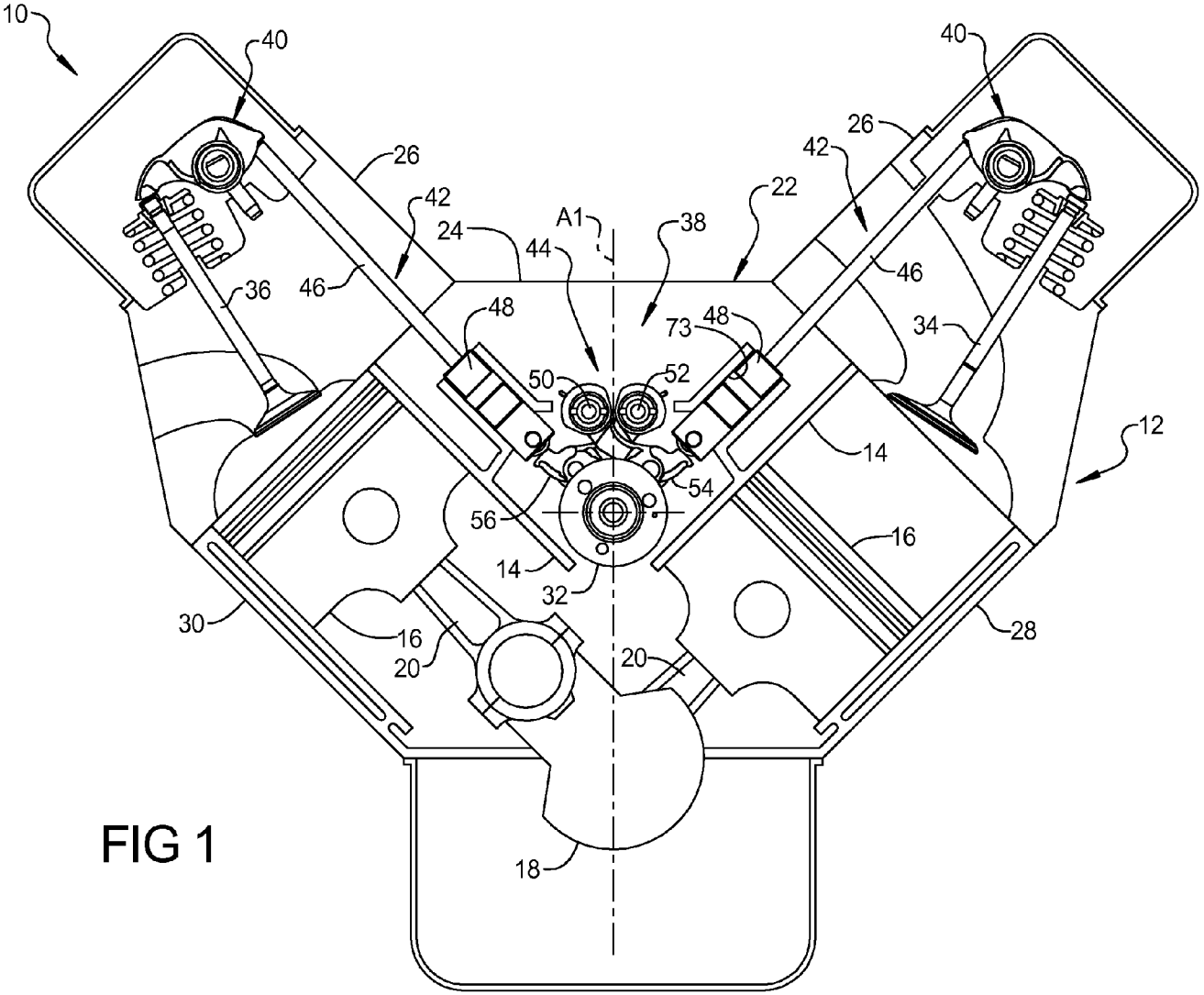
FIG. 1 is schematic illustration of an engine assembly according to the present disclosure.

With reference to FIG. 1, an engine assembly 10 is illustrated. The engine assembly 10 may include a cam-in-block design having a V-configuration. The engine assembly 10 may include an engine structure 12 defining cylinders 14, pistons 16 disposed within the cylinders 14, a crankshaft 18, connecting rods 20 coupling the pistons 16 to the crankshaft 18, and a valvetrain assembly 22. The engine structure 12 may include an engine block 24 and cylinder heads 26.

The engine block 24 may define first and second banks 28, 30 of cylinders 14 disposed at an angle relative to one another. The cylinder heads 26 may be mounted to the engine block 24 above the cylinders 14. While FIG. 1 illustrates the first and second banks 28, 30 disposed at an angle of approximately ninety degrees relative to one another, it is understood that the present disclosure applies equally to configurations having bank angles less or greater than ninety degrees. Further, it is understood that the present disclosure is not limited to engines having a V-configuration.

Figure 2:
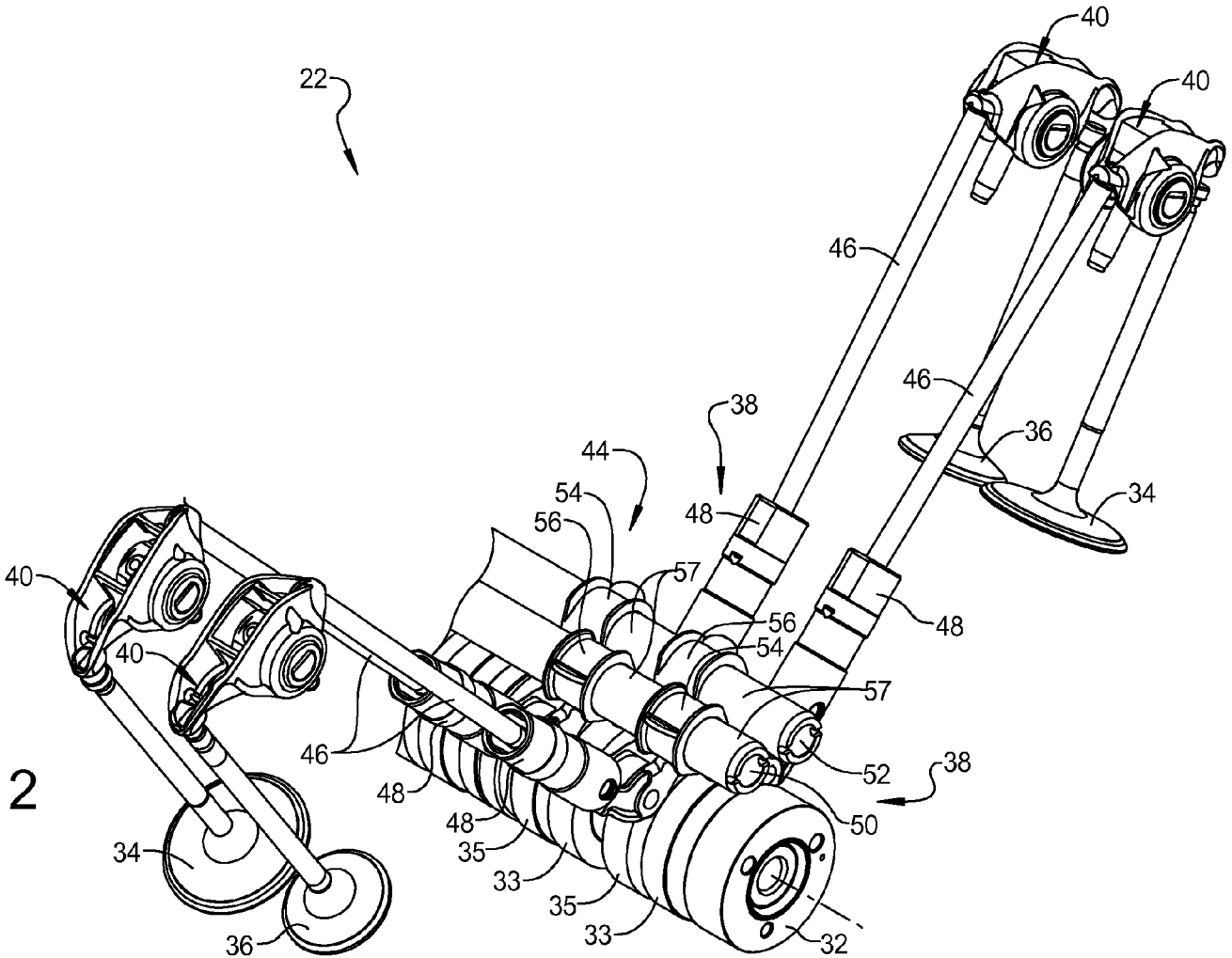
FIG. 2 is a fragmentary perspective view of the valvetrain assembly shown in FIG. 1.
Figure 3:
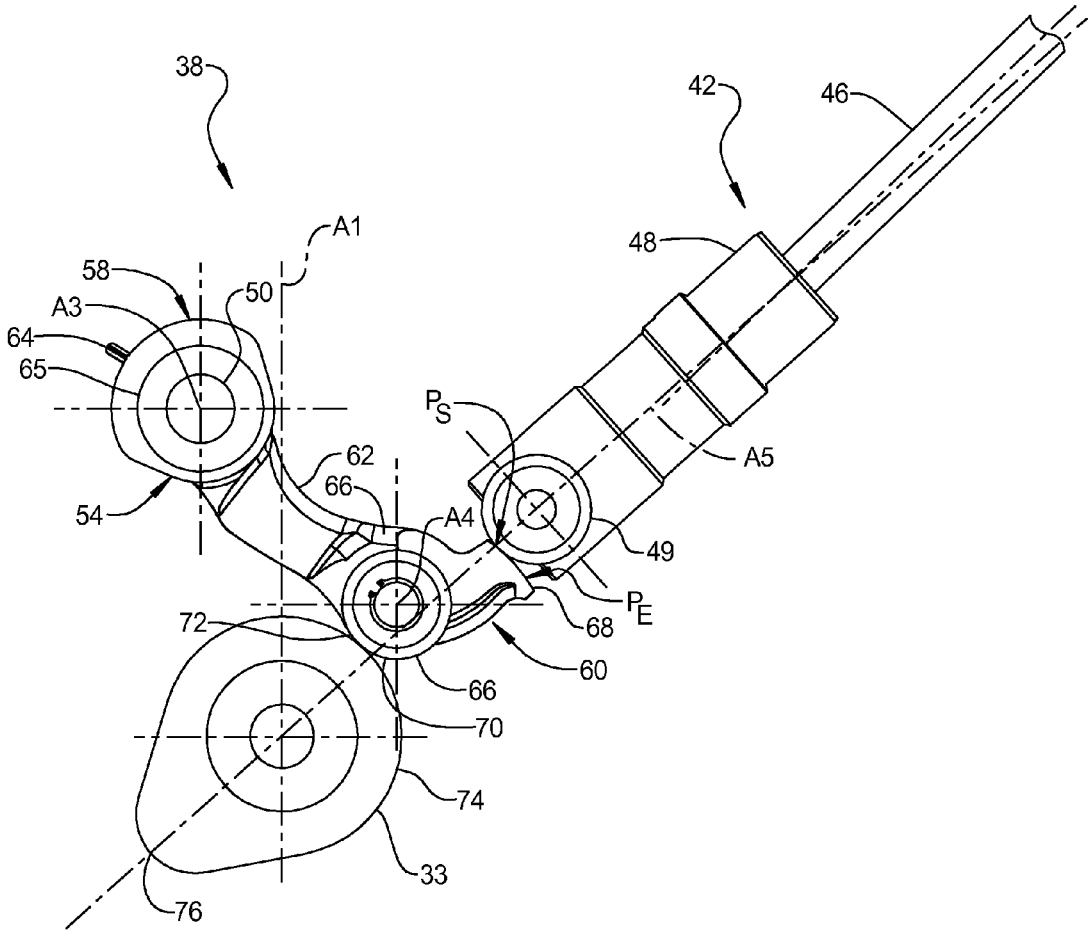
FIG. 3 is a fragmentary plan view of the valvetrain assembly shown in FIG. 1.
Figure 4:
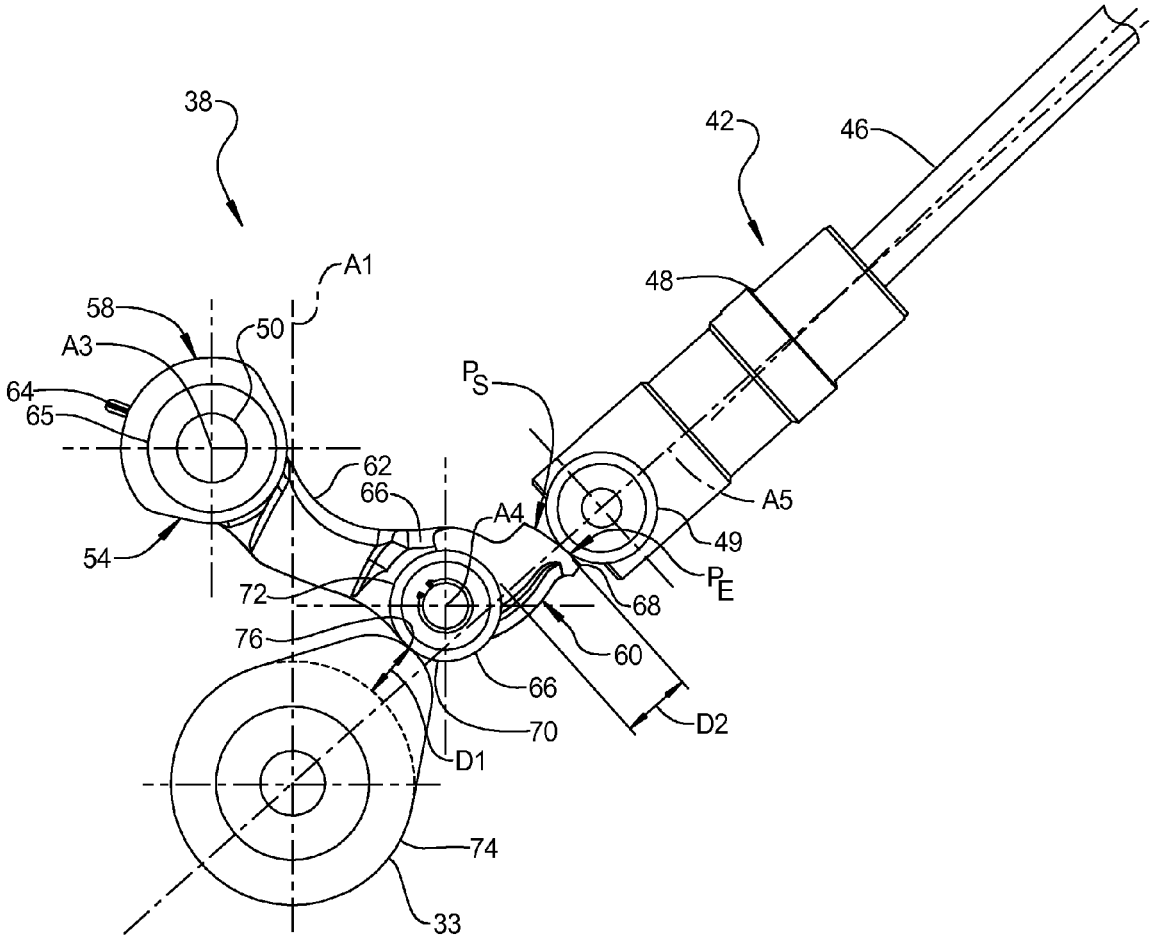
FIG. 4 is an additional fragmentary plan view of the valvetrain assembly shown in FIG. 1.

With additional reference to FIGS. 2-4, the valvetrain assembly 22 may include a camshaft 32, intake and exhaust valves 34, 36, and a valve actuation assembly 38. The camshaft 32 may include intake and exhaust lobes 33, 35. The valve actuation assembly 38 may be engaged with the intake and exhaust lobes 33, 35 and the intake and exhaust valves 34, 36 to selectively open the intake and exhaust valves 34, 36. The valve actuation assembly 38 may include first rocker arm assemblies 40, valve lift mechanisms 42, and a second rocker arm assembly 44. Each of the first rocker arm assemblies 40 may be similar to one another. Therefore, for simplicity, a single rocker arm assembly 40 will be described with respect to the intake valve 34 with the understanding that the description applies equally to the remainder of the first rocker arm assemblies 40.

The first rocker arm assembly 40 may be engaged with the intake valve 34 and may be coupled to the engine structure 12, and more specifically may be coupled to the cylinder head 26. A first end of the first rocker arm assembly 40 may be engaged with the intake valve 34 and a second end may be engaged with a first end of the valve lift mechanism 42. A second end of the valve lift mechanism 42 may be engaged with the second rocker arm assembly 44. Actuation of the first rocker arm assembly 40 by the valve lift mechanism 42 may provide for opening of the intake valve 34. The first rocker arm assembly 40 may be arranged to provide a lift ratio of greater than 1.0.

The valve lift mechanism 42 may include a pushrod 46 engaged with the second end of the first rocker arm assembly 40 and a lifter 48 engaged with the second rocker arm assembly 44. The lifter 48 may include a roller element 49 engaged with the second rocker arm assembly 44. The lifter 48 may additionally include hydraulic lash adjustment to maintain engagement between the lifter 48 and the pushrod 46. It is further understood that the lifter 48 may include a hydraulically actuated lost motion mechanism (not shown) to selectively translate displacement from the camshaft 32 to the intake and exhaust valves 34, 36.

The second rocker arm assembly 44 may include first and second shafts 50, 52, intake and exhaust rocker arms 54, 56 and spacers 57. The first and second shafts 50, 52 may be fixed to the engine structure 12, and more specifically to the engine block 24, between the first and second banks 28, 30. The first shaft 50 may be associated with the first bank 28 and located between the second shaft 52 and the second bank 30. The second shaft 52 may be associated with the second bank 30 and located between the first shaft 50 and the first bank 28. The first and second shafts 50, 52 may be located on opposite sides of a centerline (A1) of the camshaft 32.

Figure 5:
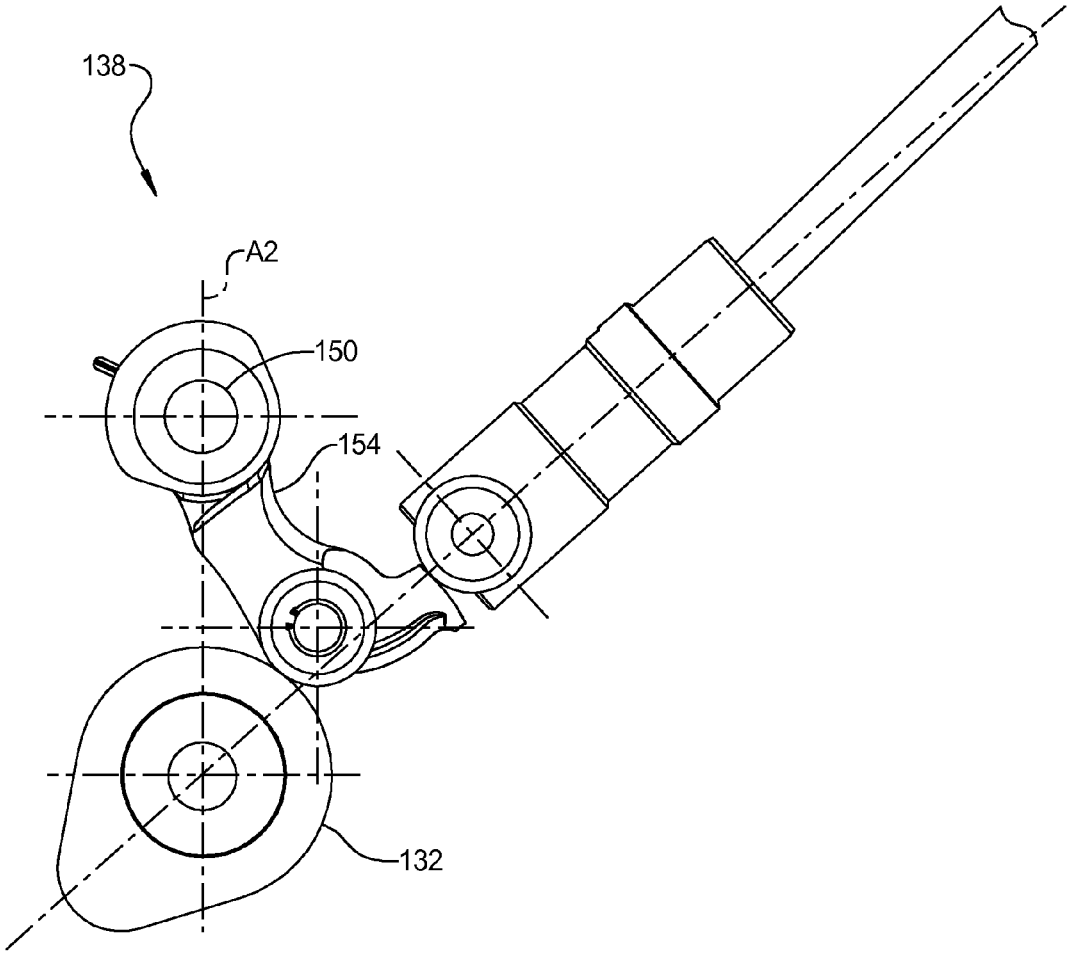
FIG. 5 is a fragmentary plan view of an alternate valvetrain assembly according to the principles of the present disclosure.

The intake and exhaust rocker arms 54, 56 may be located on the first and second shafts 50, 52. As seen in FIG. 2, spacers 57 may be located between adjacent ones of the intake and exhaust rocker arms 54, 56 on each of the first and second shafts 50, 52. The intake and exhaust rocker arms 54, 56 on the first shaft 50 may extend between adjacent ones of the intake and exhaust rocker arms 54, 56 on the second shaft 52. While illustrated as having first and second shafts 50, 52, it is understood that the present disclosure is not limited to two-shaft arrangements and applies equally to single shaft designs, as seen in FIG. 5, where the intake and exhaust rocker arms 154 are all located on a single shaft 150. In the single shaft design, the shaft 150 may be centered on the centerline (A2) of the camshaft 132. Alternatively, the shaft 150 may be offset from the centerline (A2) similar to the arrangement shown in FIGS. 1-4. The valve actuation assembly 138 of FIG. 5 may be used in engines having a V-configuration or an inline configuration.

The first and second shafts 50, 52 and intake and exhaust rocker arms 54, 56 may be generally similar to one another. Therefore, for simplicity, the intake rocker arm 54 and first shaft 50 are described in detail below with the understanding that the description applies equally to the intake rocker arms 54 on the second shaft 52 as well as the exhaust rocker arms 56 located on both the first and second shafts 50, 52. With reference to FIGS. 3 and 4, the intake rocker arm 54 may include a pivot region 58 at a first end and an engagement region 60 at a second end with a body portion 62 extending therebetween. The intake rocker arm 54 may additionally include a variety of oil control features including, but not limited to, an oil slinger 64 at the first end and a recess 66 in the body portion 62 to direct oil to the valvetrain assembly 22 during engine operation.

The pivot region 58 may be coupled to the first shaft 50 for rotation about a rotational axis (A3) defined by the first shaft 50. More specifically, the pivot region 58 may include a bearing 65 receiving the first shaft 50 therein and the intake rocker arm 54 may rotate on the first shaft 50. The engagement region 60 may include a cam engagement surface 66 engaged with the camshaft 32 and a lift surface 68 opposite the cam engagement surface 66 engaged with the valve lift mechanism 42, and more specifically with the roller element 49. The cam engagement surface 66 may be located radially between the lift surface 68 and the pivot region 58 and may define an arcuate surface 70 having a radius of curvature (R1). By way of non-limiting example, the cam engagement surface 66 may include a roller element 72 defining the arcuate surface 70 having the radius of curvature (R1). The radius of curvature (R1) may be greater than a radius of curvature (R2) defined by the roller element 49 of the lifter 48. The radius of curvature (R1) may be greater since the cam engagement surface 66 is not constrained by the size of the bore 73 (seen in FIG. 1) in the engine structure 12 housing the lifter 48. Therefore, the radius of curvature (R1) may be greater than a radius (R3) of the bore 73.

The lift surface 68 may form an arcuate convex surface extending radially outward relative to the pivot region 58 from a first (or starting) point ($P_S$) to a second (or ending) point ($P_E$). The first and second points ($P_S$, $P_E$) may both be located radially outward relative to a rotational axis (A4) defined by the roller element 72. The lift surface 68 may define a radius of curvature (R4) greater than a radius (R5) defined by the base circle 74 of the intake lobe 33. It is understood that the specific dimensions of the intake and exhaust rocker arms 54, 56 may be different from one another to achieve desired lift characteristics.

Operation of the valvetrain assembly 22 will be described with respect to the intake rocker arm 54 with the understanding that the description applies equally to the exhaust rocker arm 56. FIG. 3 illustrates the intake rocker arm 54 in a first position corresponding to a closed position for the intake valve 34. In the first position, the cam engagement surface 66 may be engaged with the base circle 74 of the intake lobe 33 and the lifter 48 may be engaged with the lift surface 68 at the first point ($P_S$). FIG. 4 illustrates the intake rocker arm 54 in a second position corresponding to a fully open position for the intake valve 34. In the second position, the cam engagement surface 66 may be engaged with the peak 76 of the intake lobe 33 and the lifter 48 may be engaged with the lift surface 68 at the second point ($P_E$).

The lifter 48 may travel across the lift surface 68 from the first point ($P_S$) to the second point ($P_E$) as the intake rocker arm 54 is displaced from the first position to the second position. The relationship between the radii of curvature (R1, R2) may produce a lower contact stress between the intake lobe 33 and the cam engagement surface 66 relative to a contact stress generated by a direct engagement between the intake lobe 33 and the lifter 48. Similarly, the relationship between the radii of curvature (R4, R5) may produce a lower contact stress between the lift surface 68 and the lifter 48 relative to a contact stress generated by a direct engagement between the intake lobe 33 and the lifter 48.

Additionally, the intake rocker arm 54 may provide a lift ratio for the lift mechanism 42 of greater than 1.0. More specifically, as illustrated in FIG. 4, a first distance (D1) may be defined between the base circle 74 and the peak 76 of the intake lobe 33. The location of the lift surface 68 relative to the cam engagement surface 66, and therefore relative to the intake lobe 33, as well as the displacement of the lifter 48 along the lift surface 68 may provide the increased displacement of the valve lift mechanism 42. FIG. 4 illustrates a second distance (D2) corresponding to the displacement of the intake rocker arm 54 from the first position to the second position. The second distance (D2) may generally correspond to the lift of the valve lift mechanism 42 along the longitudinal axis (A5) of the lifter 48 generated by the intake rocker arm 54 and may be greater than the first distance (D1), creating a lift ratio of greater than 1.0. By way of non-limiting example, the lift ratio (D2/D1) may be at least 1.1, and more specifically at least 1.2. The increased lift ratio provided by the intake rocker arm 54 may limit the angular displacement of the pushrod 46 during engine operation.

What is claimed is:

1. A valve actuation assembly comprising:

a first rocker arm including a first end defining a pivot axis to rotationally couple the first rocker arm to an engine structure and a second end defining a cam engagement surface adapted to engage a camshaft lobe and a convex lift surface opposite the cam engagement surface, an entirety of the convex lift surface being spaced for the pivot axis by a first distance greater than a second distance the cam engagement surface is spaced from the pivot axis;

a valve lift mechanism having a first end engaged with the lift surface of the first rocker arm; and a second rocker arm engaged with a second end of the valve lift mechanism to selectively open a valve based on displacement of the lift mechanism by the first rocker arm, wherein the first rocker arm is adapted to be displaceable from a first position where a base circle of the camshaft lobe is engaged with the cam engagement surface to a second position where a peak of the camshaft lobe is engaged with the cam lift surface, the first rocker arm adapted to axially displace the valve lift mechanism a first distance at least ten percent greater than a second distance defined radially between the base circle and the peak of the camshaft lobe, wherein the valve lift mechanism is adapted to slide along the lift surface from a first point on the lift surface to a second point on the lift surface as the first rocker arm is displaced from the first position to the second position, wherein the second point is located radially outward from the first point relative to the pivot axis of the first rocker arm by a distance of at least ten percent.

2. The valve actuation assembly of claim 1, wherein the convex lift surface has an arcuate shape.

3. The valve actuation assembly of claim 2, wherein the convex lift surface defines a first radius of curvature greater than a second radius of curvature of a base circle of the camshaft lobe.

4. The valve actuation assembly of claim 1, wherein the cam engagement surface defines a first radius of curvature greater than a second radius of curvature defined by the first end of the valve lift mechanism.

5. The valve actuation assembly of claim 4, wherein the cam engagement surface includes a first roller member adapted to engage the camshaft lobe and having a radius defining the first radius of curvature, the first end of the valve lift mechanism having a second roller member engaged with the lift surface and having a second radius defining the second radius of curvature.

6. An engine assembly comprising:

an engine structure;

a camshaft rotationally supported within the engine structure and including a lobe;

a first rocker arm including a first end rotationally coupled relative to the engine structure and a second end defining a cam engagement surface engaged with the lobe and a convex lift surface opposite the cam engagement surface, an entirety of the convex lift surface being spaced for the pivot axis by a first distance greater than a second distance the cam engagement surface is spaced from the pivot axis;

a valve lift mechanism having a first end engaged with the lift surface of the first rocker arm;

a valve; and a second rocker arm supported relative to the engine structure and engaged with a second end of the valve lift mechanism and the valve to selectively open the valve based on displacement of the lift mechanism by the first rocker arm, wherein the first rocker arm is displaceable from a first position where a base circle of the camshaft lobe is engaged with the cam engagement surface to a second position where a peak of the camshaft lobe is engaged with the cam lift surface, the first rocker arm axially displacing the valve lift mechanism a first distance at least ten percent greater than a second distance defined radially between the base circle and the peak of the camshaft lobe, wherein the valve lift mechanism slides along the lift surface from a first point on the lift surface to a second point on the lift surface as the first rocker arm is displaced from the first position to the second position, wherein the second point is located radially outward from the first point relative to the first end of the first rocker arm by a distance of at least ten percent.

7. The engine assembly of claim 6, wherein the convex lift surface has an arcuate shape.

8. The engine assembly of claim 7, wherein the convex lift surface defines a first radius of curvature greater than a second radius of curvature of a base circle of the camshaft lobe.

9. The engine assembly of claim 6, wherein the cam engagement surface defines a first radius of curvature greater than a second radius of curvature defined by the first end of the valve lift mechanism.

10. The engine assembly of claim 9, wherein the cam engagement surface includes a first roller member engaged with the camshaft lobe and having a radius defining the first radius of curvature, the first end of the valve lift mechanism having a second roller member engaged with the lift surface and having a second radius defining the second radius of curvature.

11. The engine assembly of claim 10, wherein the engine structure defines a bore housing the valve lift mechanism therein, the bore defining a third radius less than the first radius.

12. The engine assembly of claim 6, further comprising a first shaft fixed to the engine structure and having the first end of the first rocker arm coupled thereto.

13. An engine assembly comprising:

an engine structure defining first and second banks of cylinders disposed at an angle relative to one another;

a camshaft rotationally supported within the engine structure between the first and second banks and including lobes;

a first shaft fixed to the engine structure between the first and second banks on a first side of the camshaft adjacent the second bank;

a second shaft fixed to the engine structure between the first and second banks on a second side of the camshaft adjacent the first bank;

a first rocker arm extending from the first shaft toward the first bank and including a first end rotationally coupled to the first shaft and a second end defining a first cam engagement surface engaged with a first of the camshaft lobes and a first convex lift surface opposite the first cam engagement surface engaged with a first valve lift mechanism associated with the first bank;

a second rocker arm extending from the first shaft toward the first bank and including a first end rotationally coupled to the first shaft and a second end defining a second cam engagement surface engaged with a second of the camshaft lobes and a second convex lift surface opposite the second cam engagement surface engaged with a second valve lift mechanism associated with the first bank; and a third rocker arm extending from the second shaft toward the second bank between the first and second rocker arms and including a first end rotationally coupled to the second shaft and a second end defining a third cam engagement surface engaged with a third of the camshaft lobes and a third convex lift surface opposite the third intake cam engagement surface engaged with a third valve lift mechanism associated with the second bank.

* * * * *